US011342687B1

(12) United States Patent
Rossman et al.

(10) Patent No.: US 11,342,687 B1
(45) Date of Patent: May 24, 2022

(54) ENDFIRE ANTENNA STRUCTURE ON AN AERODYNAMIC SYSTEM

(71) Applicant: BAE Systems Information and Electronic Systems Integration Inc., Nashua, NH (US)

(72) Inventors: Court E. Rossman, Merrimack, NH (US); Maxwell L. Affleck, New Boston, NH (US); Matthew F. Chrobak, Groton, MA (US); James F. Fung, Manchester, NH (US); Paul D. Zemany, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 17/235,271

(22) Filed: Apr. 20, 2021

(51) Int. Cl.

| | |
|---|---|
| ***H01Q 21/06*** | (2006.01) |
| ***H01Q 1/28*** | (2006.01) |
| ***H01Q 11/18*** | (2006.01) |
| ***H01Q 5/335*** | (2015.01) |
| ***H01Q 1/42*** | (2006.01) |

(52) U.S. Cl.
CPC ..... *H01Q 21/067* (2013.01); *H01Q 1/427* (2013.01); *H01Q 5/335* (2015.01); *H01Q 11/18* (2013.01)

(58) Field of Classification Search
CPC ..... H01Q 1/28; H01Q 1/286; H01Q 1/427; H01Q 5/335; H01Q 11/18; H01Q 21/067
See application file for complete search history.

(56) References Cited

U.S. PATENT DOCUMENTS

| | | | | |
|---|---|---|---|---|
| 3,074,063 A * | 1/1963 | Horton | H01Q 21/0043 | 343/708 |
| 3,568,208 A * | 3/1971 | Hatcher | H01Q 3/443 | 342/368 |
| 3,810,183 A * | 5/1974 | Krutsinger | H01Q 9/0471 | 343/769 |
| 4,658,261 A * | 4/1987 | Reid | H01Q 21/0043 | 343/771 |
| 6,496,151 B1 * | 12/2002 | Ferreri | H01Q 21/0087 | 343/770 |

* cited by examiner

*Primary Examiner* — Hoang V Nguyen
(74) *Attorney, Agent, or Firm* — Finch & Maloney PLLC

(57) ABSTRACT

An endfire antenna structure is disclosed that is for use on aerodynamic systems. The antenna structure includes a first layer of patterned metal, a second layer of patterned metal, and a stack of material layers that includes the first layer of patterned metal and the second layer of patterned metal. The first layer of patterned metal includes a plurality of parallel slots etched through the metal. The second layer of patterned metal includes a tapered radio frequency (RF) feedline having a narrow end coupled to an input/output (I/O) antenna connection. The second layer of patterned metal is aligned over the first layer of patterned metal such that the tapered RF feedline has a length that extends across the plurality of parallel slots. The stack of material layers is flexible such that the stack of material layers is configured to wrap at least partially around the fuselage of an aerodynamic system.

20 Claims, 8 Drawing Sheets

ENDFIRE ANTENNA STRUCTURE ON AN AERODYNAMIC SYSTEM

BACKGROUND

Designing the various mechanical and electrical components for use on aerodynamic systems such as guided projectiles or other aerobodies is a challenge due to the limited space. Such guided aerodynamic systems often use multiple radio frequency (RF) antennas to transmit and receive radiation in different directions for guidance purposes as well as object identification. The antennas are commonly placed in the nosecone region of the guided aerodynamic system to minimize interference from the body of the aerodynamic system. Multiple antennas at different orientations are typically used to transmit or capture RF radiation at various angles. However, it is not always possible or feasible to place the antennas in the nosecone. In many applications, other systems or payloads are used in the nosecone that can interfere with the antennas or otherwise make it difficult to share the space. Accordingly, there are many non-trivial issues with regards to designing antennas for use on an aerodynamic system.

BRIEF DESCRIPTION OF THE DRAWINGS

Features and advantages of embodiments of the claimed subject matter will become apparent as the following Detailed Description proceeds, and upon reference to the Drawings, in which:

Figure 1:
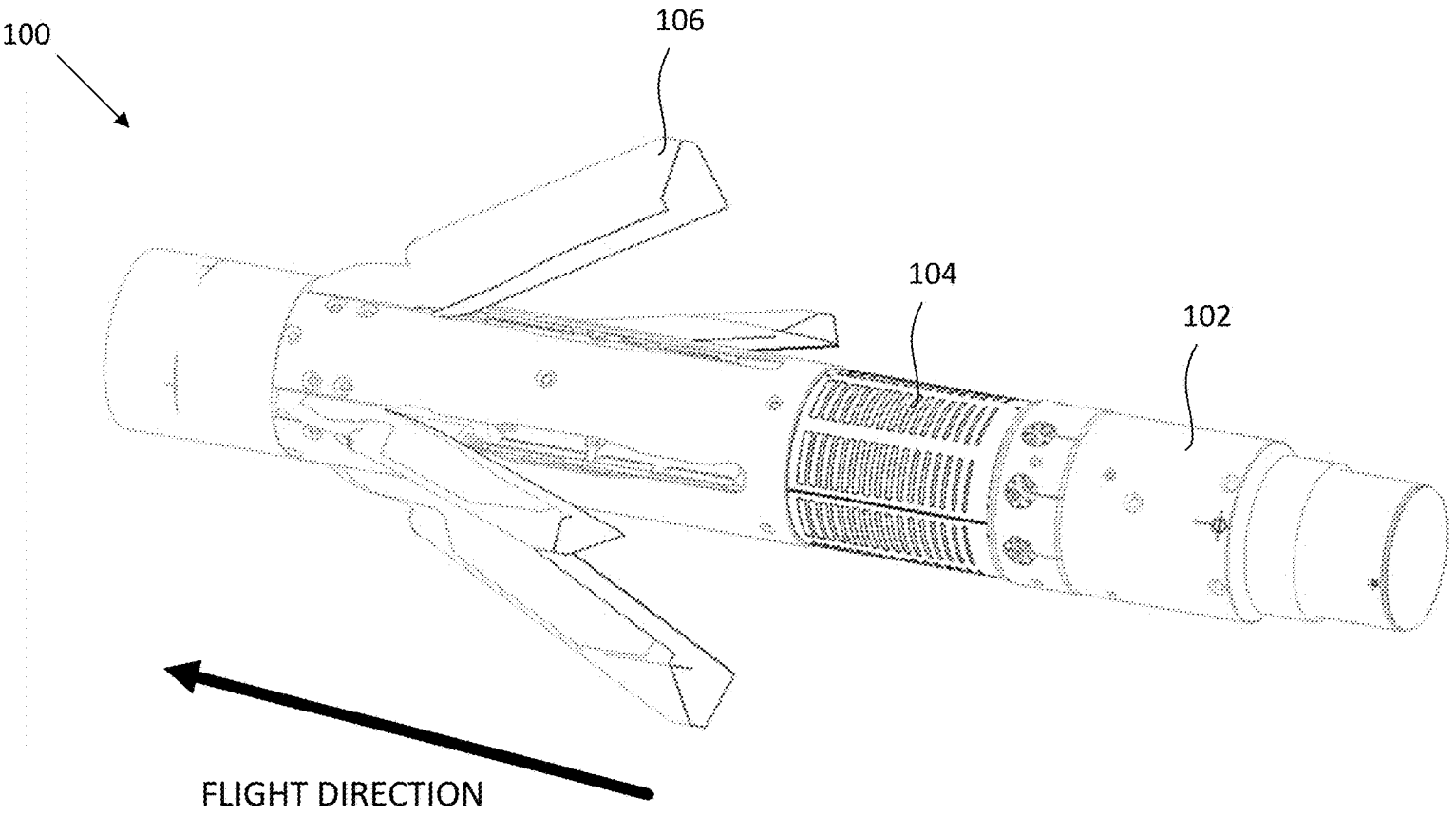
FIG. 1 illustrates an example aerodynamic system configured with a contoured antenna structure, in accordance with an embodiment of the present disclosure.

Although the following Detailed Description will proceed with reference being made to illustrative embodiments, many alternatives, modifications, and variations thereof will be apparent in light of this disclosure.

DETAILED DESCRIPTION

An endfire antenna structure is disclosed that is especially well-suited for use on aerodynamic systems such as guided projectiles or other aerobodies. In an embodiment, the antenna structure is formed on a flexible substrate along with one or more other flexible layers that wrap around a cylindrical fuselage of an aerodynamic system. In another embodiments, the antenna structure includes two separate metal layers between a stack of other material layers that together wrap around the cylindrical fuselage of the aerodynamic system. The antenna structure includes a plurality of tapered feedlines aligned over corresponding slot arrays to direct radiation towards the front of the aerodynamic system, according to some embodiments. Additionally, a dielectric layer is used over the outer surface of the antenna to create a leaky surface wave that directs the radiation in a forward direction towards the front of the aerodynamic system, according to some embodiments. Numerous embodiments and variations will be appreciated in light of this disclosure.

General Overview

As noted above, it is often desirable to enable different locations for the antennas around an aerodynamic system, rather than only placing the antennas in the nose. In some example cases, the aerodynamic system is a guided munition or projectile such as a bullet, shell, missile, torpedo, or rocket, to name a few examples. For many guided munitions or projectiles, the nose area often carries a particular payload and/or other components that can leave little to no room for the antennas. In such cases, note the payload carried by the aerodynamic system can vary from one application to the next, and need not be limited to explosives or lethal payloads. For instance, the payload could be supplies (e.g., food, equipment), personnel, communications gear (e.g., to provide an airborne communications node over a given region), imaging gear or other sensor-based gear (e.g., weather sensors such as for temperature and humidity, gas sensors, speed sensors), illumination gear (e.g., to illuminate an area with visible light), and surveillance gear, to name a few examples.

Accordingly, the present disclosure provides antenna structures suitable for aerodynamic systems. In an embodiment, one or more endfire antennas are contour mounted around the fuselage of the aerodynamic system back away from the nose, while directing radiation in a forward direction (e.g., towards the flight direction). In general, an endfire antenna is a linear or cylindrical antenna structure that emits or otherwise outputs its radiation from one end. The direction of maximum radiation is along the axis (from input to output) of the structure, and it can be unidirectional or bidirectional. The features of the endfire antenna structure will be explained in turn. In some examples, the one or more endfire antennas are wrapped around at least a portion of a cylindrical fuselage on a guided projectile, such as a guided rocket or missile. The one or more endfire antennas can have different polarizations due to their ground plane orientation and can exhibit gain shadowing due to the presence of the aerodynamic system beneath the antenna substrate.

According to some embodiments, the endfire antenna includes a first layer of patterned metal having a tapered feedline and a second layer of patterned metal above the first layer, where the second layer includes a plurality of parallel slots aligned over the tapered feedline. Electrical energy propagates down the tapered feedline from its narrow end to its wide end and couples through the slots in the second metal layer above to radiate outwards. The energy couples weakly at the narrow end of the feedline and more strongly at the wide end of the feedline. The wide end of the tapered feedline is connected to a ground plane via a resistor, according to some embodiments.

Each of the first and second metal layers may be patterned on two different sides of the same substrate, where the substrate is flexible enough to wrap around the outside of a cylindrical fuselage. In some embodiments, the substrate is configured to flex around or wrap around generally any contoured shape on the outside of the aerodynamic system. According to some embodiments, many tapered feedlines with corresponding parallel slots are arranged in a parallel array on the substrate such that the array wraps around the fuselage and directionally transmits or receives radiation (e.g., towards the front of the aerodynamic system).

According to one example embodiment of the present disclosure, an antenna structure configured to wrap around a fuselage of an aerodynamic system includes a first layer of patterned metal, a second layer of patterned metal, and a stack of material layers that includes the first layer of patterned metal and the second layer of patterned metal. The stack may further include one or more dielectric layers and/or one or more bonding layers, as will be discussed in turn with reference to FIG. 5. The first layer of patterned metal includes a plurality of parallel slots etched through the metal with each of the parallel slots extending lengthwise in a first direction. The second layer of patterned metal includes a tapered radio frequency (RF) feedline having a narrow end a wide end. The narrow end is coupled to an input/output (I/O) antenna connection. The second layer of patterned metal is aligned over the first layer of patterned metal such that the tapered RF feedline has a length that extends across the plurality of parallel slots in a second direction substantially perpendicular to the first direction. The stack of material layers is flexible such that the stack of material layers is configured to wrap around the fuselage of the aerodynamic system.

According to another example embodiment of the present disclosure, an RF system configured for use on an aerodynamic system includes a processor configured to generate a digital signal, at least one digital to analog converter (DAC) configured to transform the digital signal into an analog signal, front end circuitry configured to receive and process the analog signal from the DAC to produce an RF signal for transmission, and an antenna structure configured to radiate the RF signal received from the front end circuitry. The front end circuitry may perform any of amplification, up-converting (mixing) in the transmit direction, down-converting in the receive direction, modulation in the transmit direction, demodulation in the receive direction, or filtering to the RF signal. The antenna structure includes a first layer of patterned metal, a second layer of patterned metal, and a stack of material layers that includes the first layer of patterned metal and the second layer of patterned metal. The stack may further include one or more additional layers (e.g., dielectric, bonding). The first layer of patterned metal includes a plurality of parallel slots etched through the metal with each of the parallel slots extending lengthwise in a first direction. The second layer of patterned metal includes a tapered RF feedline having a narrow end a wide end. The narrow end is coupled to an input/output (I/O) antenna connection. The second layer of patterned metal is aligned over the first layer of patterned metal such that the tapered RF feedline has a length that extends across the plurality of parallel slots in a second direction substantially perpendicular to the first direction. The stack of material layers is flexible such that the stack of material layers is configured to wrap around the fuselage of the aerodynamic system.

According to another example embodiment of the present disclosure, a method of making an antenna structure configured for use on an aerodynamic system includes wrapping a sheet having a plurality of dielectric material slabs around a fuselage of the aerodynamic system; removing the sheet, thus leaving behind the dielectric material slabs within corresponding cavities in the fuselage; wrapping a flexible substrate around the fuselage and over the dielectric material slabs; and wrapping a dielectric layer around the fuselage and over the flexible substrate. The flexible substrate includes a first layer of patterned metal and a second layer of a patterned metal. The first layer of patterned metal includes a plurality of parallel slots etched through the metal with each of the parallel slots extending lengthwise in a first direction. The second layer of patterned metal includes a tapered RF feedline having a narrow end a wide end. The narrow end is coupled to an input/output (I/O) antenna connection. The second layer of patterned metal is aligned over the first layer of patterned metal such that the tapered RF feedline has a length that extends across the plurality of parallel slots in a second direction substantially perpendicular to the first direction.

The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous.

Aerodynamic System Overview

FIG. 1 illustrates an example of an aerodynamic system 100. As previously noted, the aerodynamic system 100 may be any caliber or type of guided projectile that houses electrical components, such as RF communication components or other guidance electronics. In one example, aerodynamic system 100 is a guided munition, such as a guided missile or rocket (e.g., surface-to-air, air-to-air, or any other guided munition that communicates with antennas), but other applications will be apparent.

According to some embodiments, aerodynamic system 100 includes a fuselage 102 that acts as an outer shell or hull to contain the various elements of aerodynamic system 100. In some examples, fuselage 102 has a cylindrical shape yielding a substantially circular cross-section. Fuselage 102 may have an outer radius between about 1.5 inches and 9 inches (e.g., 4.5 inches). According to some embodiments, an antenna structure 104 is wrapped around at least a portion of the circumference of fuselage 102. Antenna structure 104 may be wrapped around an entire circumference of fuselage 102. Antenna structure 104 includes an array of endfire antennas having tapered feedlines to direct radiation towards the noted flight direction of aerodynamic system 100. The outside layer of metal includes an array of parallel slots. Each of the individual parallel slots has a length along a first direction (curling around the outside of fuselage 102), and each set of parallel slots is arranged along a second direction substantially perpendicular to the first direction, where the second direction is along the length of aerodynamic system 100 (e.g., in same direction as the flight direction). As used herein, the term "substantially" means within 5 degrees when used to describe angles. So, for example, if a first direction is substantially perpendicular to a second direction, then the angle formed by the intersection of the first and second directions is in the range of 85 to 95 degrees. Each set of parallel slots represents one endfire antenna with its own tapered feedline (not shown as the feedlines are under the slots) such that antenna structure 104 includes a plurality of endfire antennas oriented along the flight path direction of aerodynamic system 100. More details regarding the design and fabrication of the endfire antennas is provided herein.

Fuselage 102 may have any number of configurations and may be implemented from any number of materials. For instance, fuselage 102 may be a cylinder of light weight material such as titanium or a polymer composite. Fuselage 102 may be one monolithic piece of material or may be multiple pieces that are individually formed and then joined in a subsequent process. In the latter case, multiple materials may be used, such as an aluminum end cap, a titanium central body portion, and a polymeric nose cone, in one example case. Fuselage 102 generally has a length that extends along the flight direction (e.g., between a nose cone and an end cap or rear end of fuselage 102). In a more general sense, fuselage 102 is not intended to be limited to any particular design or configuration, as will be appreciated in light of this disclosure.

In some embodiments, antenna structure 104 is slightly recessed such that a top surface of antenna structure 104 is flush with an outside surface of fuselage 102. The top surface of antenna structure 104 may be a dielectric material that acts as a radome for the underlying antennas. The dielectric material is loaded with polytetrafluoroethylene (PTFE), in some embodiments.

Aerodynamic system 100 may include one or more wings 106, or fins (e.g., tail fins, mid-body fins, front fins, moveable or controllable fins, fixed fins, and/or any other such guided projectile features). The tilt angle and general orientation of each of wings 106 can be independently controlled via a guidance system on board aerodynamic system 100 to change the flight path. In a more general sense, aerodynamic system 100 is not intended to be limited to any particular set of wings 106 or other fins, and some designs may not have any fins, as will be appreciated.

Figure 2:
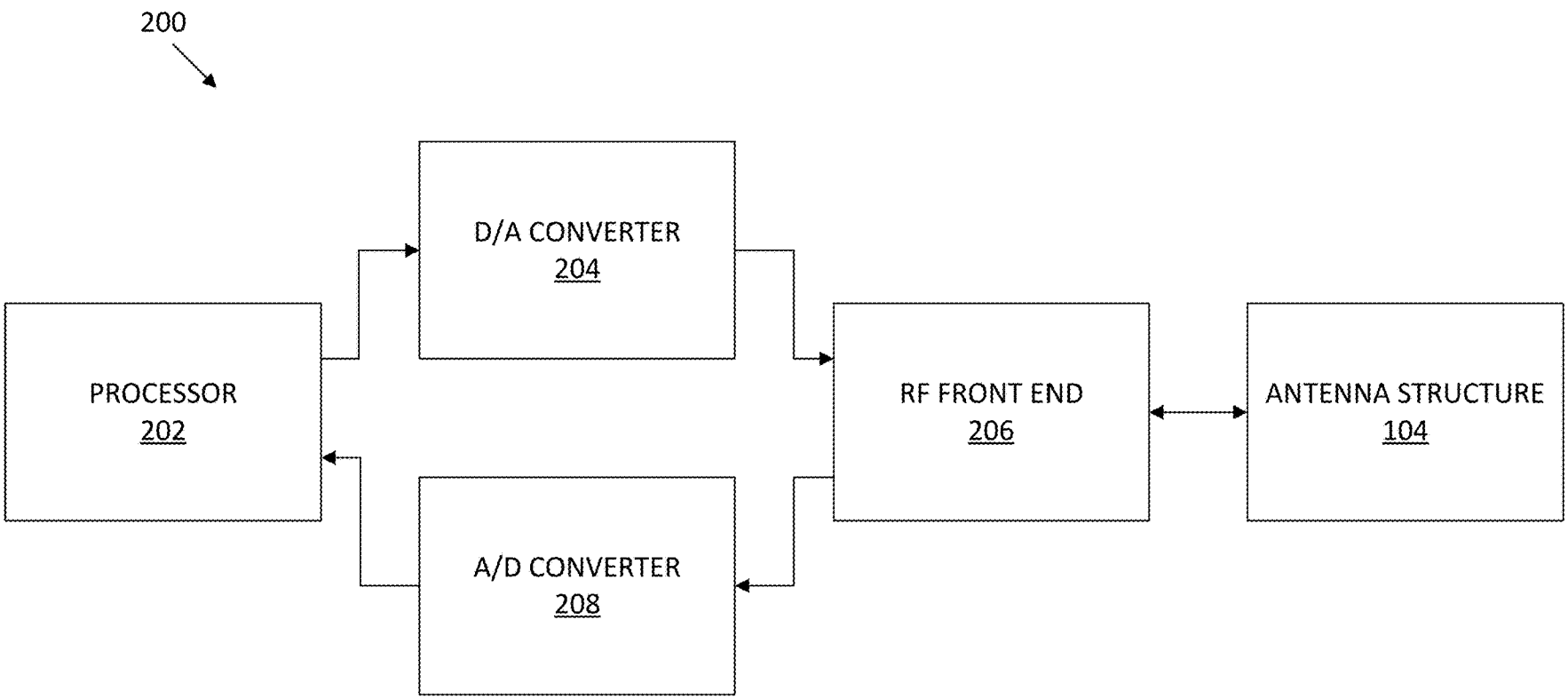
FIG. 2 is a block diagram illustrating a signal processing environment on board the example aerodynamic system of FIG. 1, in accordance with an embodiment of the present disclosure.

FIG. 2 illustrates an example RF system 200 that can be used on board aerodynamic system 100 to transmit and/or receive RF radiation. According to some embodiments, the RF radiation is transmitted for guidance and/or homing purposes. RF system 200 includes a processor 202, a digital-to-analog converter (DAC) 204, RF front end circuitry 206, an analog-to-digital converter (ADC) 208, and antenna structure 104. In some cases, any of processor 202, DAC 204, RF front end circuitry 206, or ADC 208 is implanted as a system-on-chip, or a chip set populated on a printed circuit board (PCB) which may in turn be populated into a chassis of a multi-chassis system or an otherwise higher-level system, although any number of implementations can be used. RF system 200 may be one portion of an electronic device on board aerodynamic system 100 that sends and/or receives RF signals.

Processor 202 may be configured to generate and/or receive digital signals to be used for communication or guidance purposes. As used herein, the term "processor" may refer to any device or portion of a device that processes electronic data from registers and/or memory to transform that electronic data into other electronic data that may be stored in registers and/or memory. Processor 202 may include one or more digital signal processors (DSPs), application-specific integrated circuits (ASICs), central processing units (CPUs), custom-built semiconductor, or any other suitable processing devices.

DAC 204 may be implemented to receive a digital signal from processor 202 and convert the signal into an analog signal that can be transmitted via antenna structure 104. DAC 204 may be any known type of DAC without limitation. In some embodiments, DAC 204 has a linear range of between about 6 GHz and about 12 GHz, and the input resolution is in the range of 6 to 12 bits, although the present disclosure is not intended to be limited to such specific implementation details.

RF front end circuitry 206 may include various components that are designed to filter, amplify, and tune selected portions of a received analog signal, according to an embodiment. RF front end circuitry may be designed to have a high dynamic range that can tune across a wide bandwidth of frequencies. For example, RF front end circuitry 204 may include components that are capable of tuning to particular frequency ranges within a signal having a bandwidth in the gigahertz range, such as bandwidths between 5 GHz and 50 GHz. In some embodiments, RF front end circuitry 204 modulates the received AC signal from DAC 204 onto a lower frequency carrier signal. In some embodiments, RF front end circuitry 204 receives an analog signal from antenna structure 104 and performs one or more of demodulation, filtering, or amplification of the received signal. In some embodiments, RF front end circuitry 204 includes one or more integrated circuit (IC) chips packaged together in a system-in-package (SIP).

ADC 208 may be implemented to receive an analog signal from RF front end circuitry 206 and convert the signal into a digital signal that can be received by processor 202 for further analysis. ADC 208 may be any known type of ADC without limitation. In some embodiments, ADC 208 has a linear range of between about 6 GHz and about 12 GHz, and the input resolution is in the range of 6 to 12 bits, although the present disclosure is not intended to be limited to such specific implementation details.

Antenna structure 104 receives the RF signal from RF front end circuitry 206 and transmits the signal out and away from aerodynamic system 100, according to some embodiments. The RF signal may be fed to the narrow end of each of a plurality of tapered feedlines that are arranged together around the fuselage of aerodynamic system 100. In some embodiments, antenna structure 104 receives RF radiation impinging upon aerodynamic system 100 and converts the received RF radiation to an analog signal that is received by RF front end circuitry 206.

Endfire Antenna Design

Figure 3A:
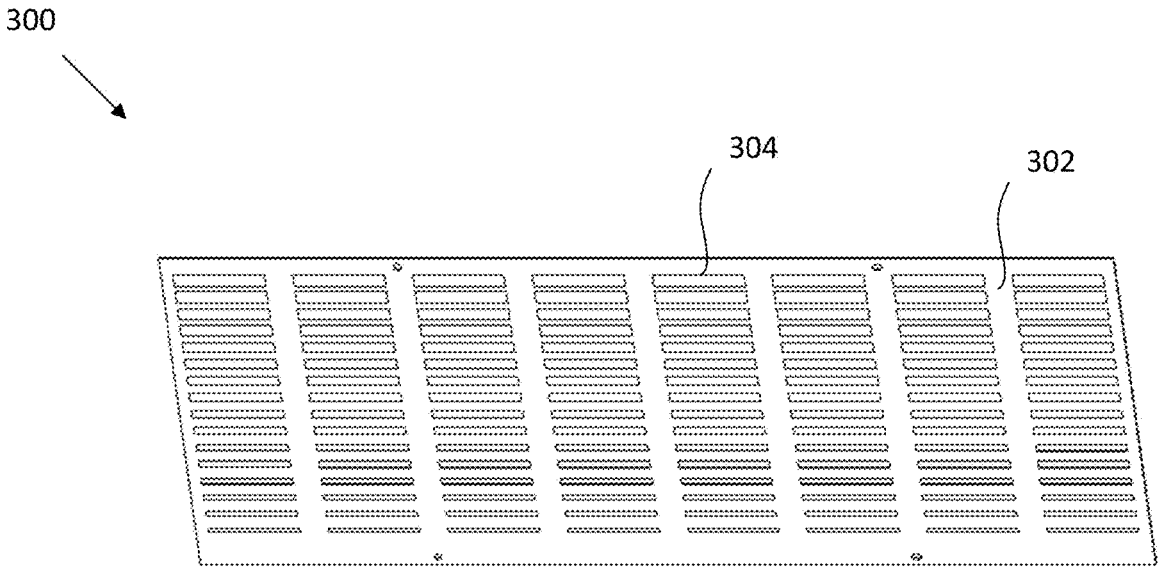
FIGS. 3A and 3B respectively illustrate front side and back side views of a substrate, and in particular, front side and back side metal patterns on the substrate, in accordance with an embodiment of the present disclosure.
Figure 3B:
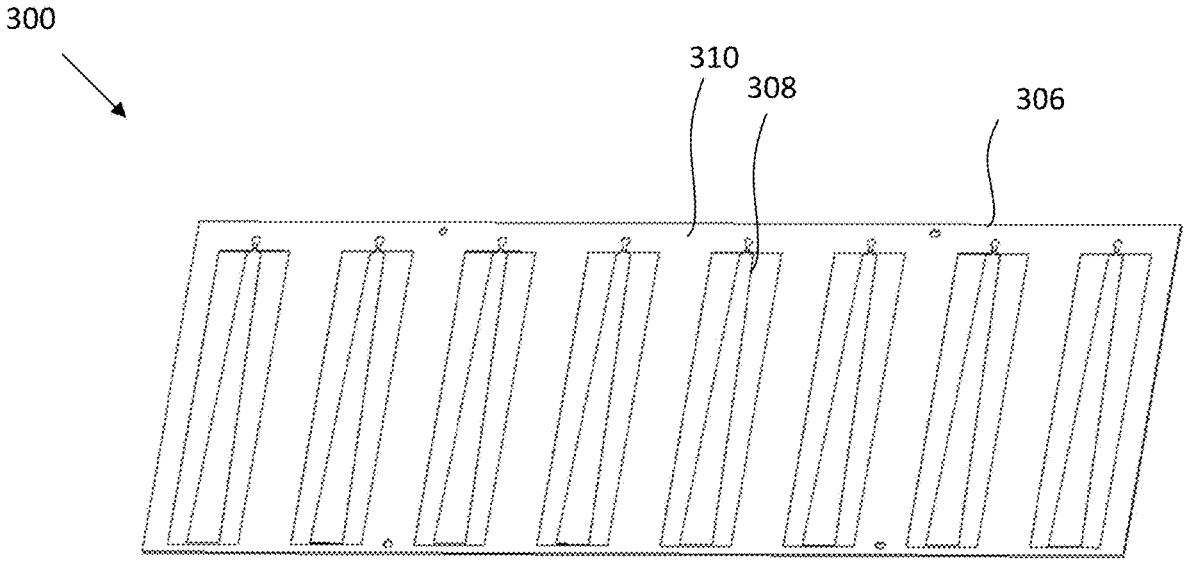

FIGS. 3A and 3B illustrate opposite sides of an example antenna substrate 300 that includes two patterned metal layers that form an array of endfire antennas, according to some embodiments. Antenna substrate 300 includes a first layer of patterned metal 302 on a first side of a substrate as illustrated in FIG. 3A and a second layer of patterned metal 306 on the opposite side of the substrate as illustrated in FIG. 3B, such that flipping the substrate over reveals either the first or second layer of patterned metal. According to some embodiments, antenna substrate 300 has a length between about 8 inches and about 9 inches, and a height between about 3 inches and about 4 inches. The length of antenna substrate 300 may be any suitable length to wrap entirely around fuselage 102 of aerodynamic system 100. In some examples, the substrate is any PCB material that is sufficiently flexible to bend around the circumference of aerodynamic system 100. The patterned features of first layer of patterned metal 302 align with the patterned features of second layer of patterned metal 306.

According to some embodiments, first layer of patterned metal 302 includes a plurality of parallel slots 304 where the metal has been removed. Slots 304 may each have a length between about 0.5 inches and about 1.0 inch. In some embodiments, slots 304 have a length around 0.8 inches. According to some embodiments, slots 304 are arranged in parallel sets across first layer of patterned metal 302. Each set of slots 304 includes slots with different widths, with a widest slot at one end of a given set and a narrowest slot at the opposite end of the given set. Slots between the widest and narrowest slots in a given set have progressively larger widths as described with more detail with reference to FIG. 4A. According to some embodiments, adjacent sets of slots 304 are separated by a distance between about 0.75 inches and about 1.25 inches. The metal of first layer of patterned metal 302 is electrically grounded to ensure that there is no floating charge present that would disrupt the RF transmission.

According to some embodiments, second layer of patterned metal 306 includes a series of tapered feedlines 308 surrounded by a ground plane 310. As the name implies, ground plane 310 is electrically grounded to the same ground as the metal of first layer of patterned metal 302. Each tapered feedline 308 aligns with a corresponding set of slots 304, such that the length of tapered feedline 308 extends in a direction that is substantially perpendicular to the lengthwise direction of slots 304, according to some embodiments. An antenna input/output (I/O) is coupled to the narrow end of feedline 308 such that electrical energy propagates down feedline 308 towards the wide end (during RF transmission) before being dissipated into ground plane 310 via a resistor connected between the wide end of tapered feedline 308 and ground plane 310, as shown in more detail with reference to FIG. 4B.

Although illustrated as a flat sheet for clarity purposes, antenna substrate 300 is designed to be wrapped around the fuselage of an aerodynamic system. For an aerodynamic system with a cylindrical fuselage, antenna substrate 300 is designed to wrap around at least a portion of the circumference of the fuselage. In some embodiments, antenna sub state 300 wraps around the entire circumference of the fuselage as illustrated in FIG. 1. Eight endfire antennas are illustrated on antenna substrate 300 and arranged in a parallel array, according to some embodiments. Any number of endfire antennas can be arranged across antenna substrate 300. In some embodiments, the number of endfire antennas on antenna substrate 300 is a multiple of four.

Figure 4A:
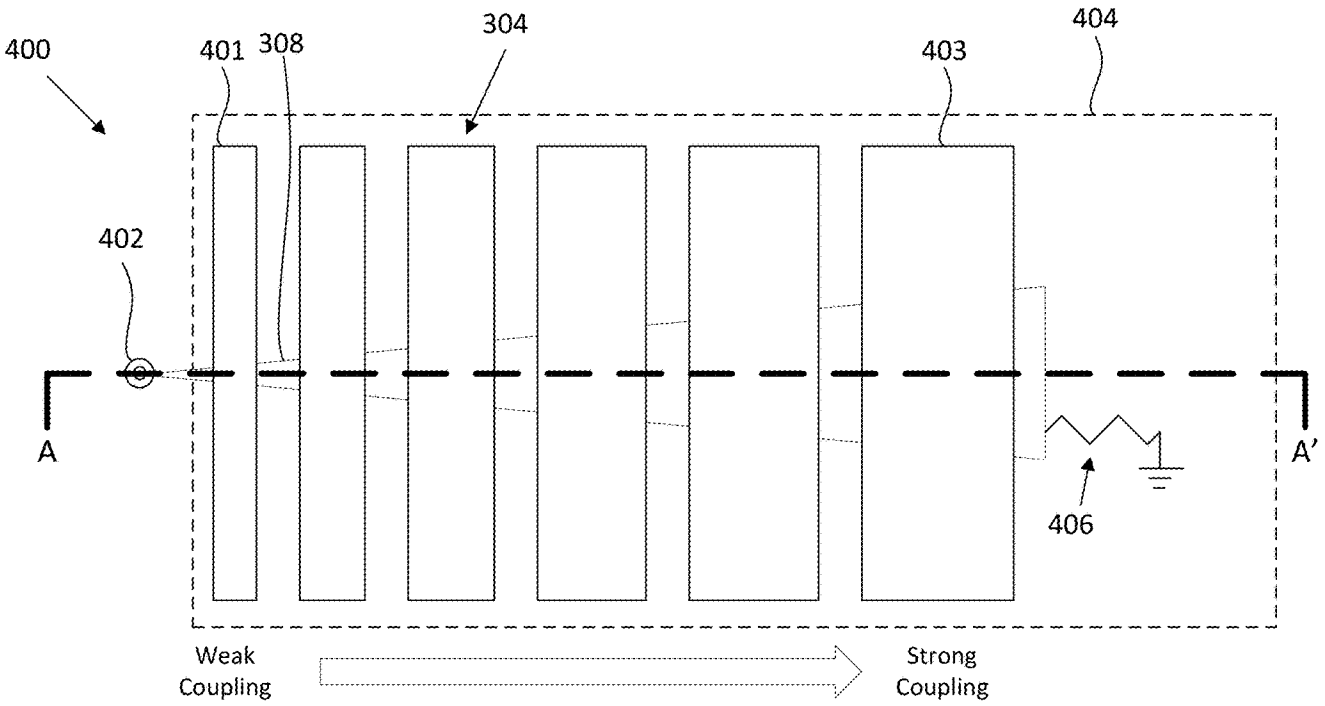
FIGS. 4A and 4B respectively illustrate top-down and side views of an endfire antenna design, in accordance with an embodiment of the present disclosure.

FIG. 4A illustrates a top-down view of one example endfire antenna 400 that includes the first and second patterned metal layers shown in FIG. 3, according to some embodiments. Note that the specific elements illustrated in FIG. 4A are not necessarily drawn to scale and are used primarily for descriptive purposes. Slots 304 are aligned over a corresponding tapered feedline 308 as discussed above, such that tapered feedline 308 extends in a direction that is substantially perpendicular to the lengthwise direction of slots 304. Note that slots 304 are present in a first plane and tapered feedline 308 is present in a parallel second plane beneath the first plane.

According to some embodiments, the widths of the various slots 304 increase in a direction from the narrow end of feedline 308 to the wide end of feedline 308. In some examples, a narrowest slot 401 is aligned the closest to the narrowest end of tapered feedline 308 and a widest slot 403 is aligned the closest to the widest end of tapered feedline 308. According to some embodiments, narrowest slot 401 is between 0.01 and 0.07 inches wide while widest slot is between 0.08 and 0.18 inches wide. In one example, narrowest slot is around 0.04 inches wide while widest slot 403 is around 0.13 inches wide. Some slot designs may vary slightly from that illustrated in FIG. 4A. For example, some slots can have a same width or be arranged with different spacing between one another. Some other examples slot designs are provided herein with reference to FIGS. 7A and 7B.

According to some embodiments, slots 304 are arranged such that they have an approximately ¼ wavelength spacing between adjacent slots. Accordingly, the designed spacing between slots can be application dependent and change based on the RF radiation wavelength of interest. In some embodiments, slots 304 are designed to have between ½ wavelength and ¼ wavelength spacing between adjacent slots.

An antenna I/O 402 is provided at the narrowest end of tapered feedline 308, according to some embodiments. Antenna I/O can represent any kind of coupling, such as a wire soldered to tapered feedline 308. Analog signals to be transmitted as RF radiation are applied to tapered feedline 308 via antenna I/O 402. During signal transmission, weaker coupling occurs at the narrow end of tapered feedline 308 due to the narrow portion of tapered feedline 308 overlapping with thinner slots, while stronger coupling occurs at the wider end of tapered feedline 308 due to the wider portion of tapered feedline 308 overlapping with wider slots. Additionally, RF signals received by the endfire antenna will generate electrical signals along tapered feedline 308 that are received at antenna I/O 402.

According to some embodiments, endfire antenna 400 is provided above a cavity 404. In some embodiments, cavity 404 is provided in the outer surface of the fuselage of an aerodynamic system, such that endfire antenna 400 (as part of a flexible antenna substrate) wraps around the fuselage and is above cavity 404. Cavity 404 is electrically grounded to the same ground as first layer of patterned metal 302 and ground plane 310 of second layer of patterned metal 306.

As noted above, the wide end of tapered feedline 308 terminates with a resistor 406 connected to an electrically grounded ground plane 310, according to some embodiments. Resistor 406 may have a resistance between about 10 Ohm and 50 Ohm. In some embodiments, resistor 406 has a resistance of about 30 Ohm. According to some embodiments the resistance of resistor 406 is chosen to eliminate or substantially reduce any backward wave forming across tapered feedline 308. Resistor 406 can be made from any standard resistor materials such as carbon, metal oxides or nitrides, or ceramics to name a few examples.

Figure 4B:
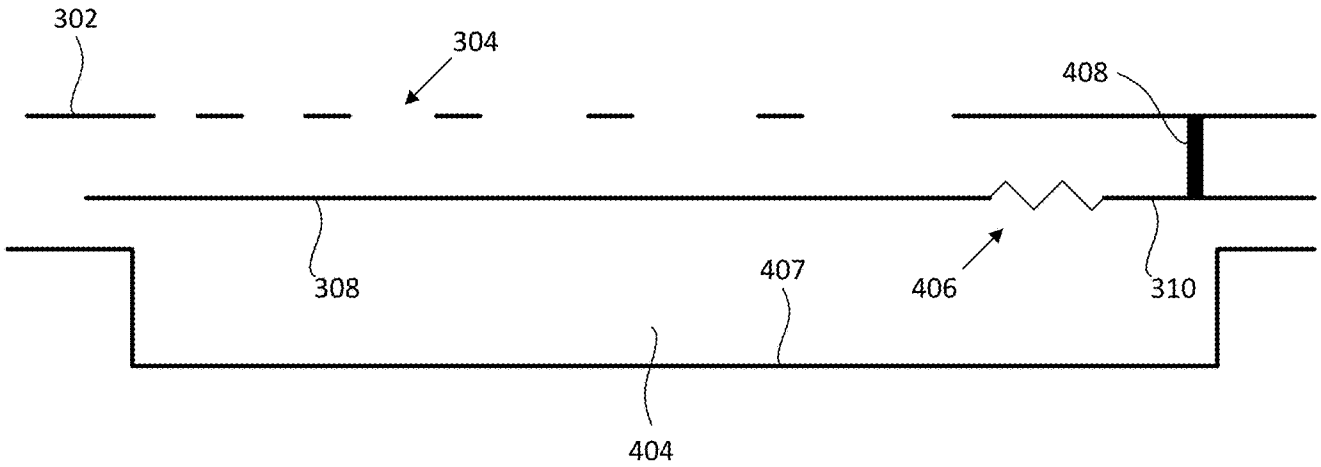

FIG. 4B illustrates a cross-section view of the first and second patterned metal layers taken through plane A-A', according to some embodiments. The space between first layer of patterned metal 302 and the underlying second layer of patterned metal with tapered feedline 308 and ground plane 310 may include a substrate having first layer of patterned metal 302 on a top surface of the substrate and both tapered feedline 308 and ground plane 310 on a bottom surface of the substrate. Resistor 406 is coupled between the wide end of tapered feedline 308 and ground plane 310. According to some embodiments, tapered feedline 308 is closer to first layer of patterned metal 302 then to a grounded surface 407 of cavity 404 to enable better RF coupling with slots 304. Although not shown for clarity, cavity 404 may be filled with a dielectric material that may be same as a dielectric material used between the first and second patterned metal layers. In some other embodiments, the dielectric material within cavity 404 has a lower dielectric constant compared to a dielectric constant of an antenna substrate with the first and second patterned metal layers on opposite sides of the antenna substrate. According to some embodiments, a separate cavity 404 is used beneath each endfire antenna 400 (e.g., for each of the endfire antennas illustrated across substrate 300) to avoid mutual coupling underneath the slots and corruption of any of the radiating RF patterns.

According to some embodiments, a conductive connection 408 may be made to electrically connect ground plane 310 with first layer of patterned metal 302. Conductive connection 408 may be a via filled with a conductive material (e.g., a plated through-hole) that extends through a thickness of an antenna substrate. In some other examples, conductive connection 408 represents one or more metal traces or wires used to connect ground plane 310 with first layer of patterned metal 302.

Figure 5A:
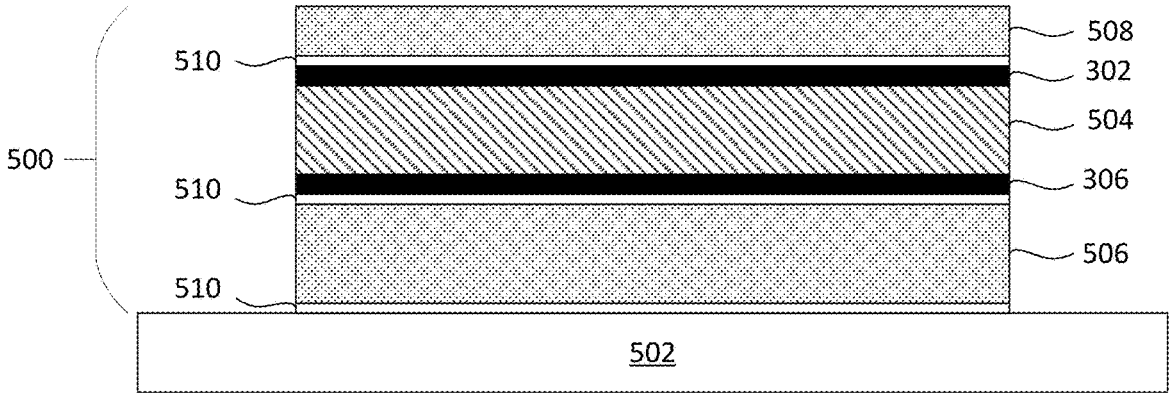
FIGS. 5A and 5B each illustrates a layer structure for an antenna design, in accordance with an embodiment of the present disclosure.

FIG. 5A illustrates a cross-section view of a stack of material layers 500 that make up an antenna structure wrapped around a fuselage of an aerodynamic system, according to an embodiment. Stack of material layers 500 may be disposed on an outer metallic surface 502 of the fuselage. According to some embodiments, stack of material layers 500 includes both first layer of patterned metal 302 and second layer of patterned metal 306 on either sides of an antenna substrate 504. Any dielectric material or multi-layer dielectric material can be used for antenna substrate 504. In some examples, antenna substrate 504 is a laminate substrate (e.g., Rogers RT/duroid 5880 high frequency laminates, which are PTFE composites reinforced with glass microfibers, to name an example) with a thickness of around 500 micrometers. In some examples, antenna substrate 504 has a dielectric constant between about 1.75 and about 2.25.

Stack of material layers 500 also includes a lower dielectric layer 506 sandwiched between second layer of patterned metal 306 and outer metallic surface 502 of the fuselage. According to some embodiments, lower dielectric layer 506 is used to fill a cavity in the fuselage, such that outer metallic surface 502 represents grounded surface 407 of the cavity as seen in FIG. 4B. Lower dielectric layer 506 may have a lower dielectric constant than antenna substrate 504. For example, lower dielectric layer 506 may have a dielectric constant between 1 and 1.2. In some embodiments, lower dielectric layer 506 has a thickness of around 2.5 mm. In some embodiments, lower dielectric layer 506 includes polymethacrylimide (PMI).

Stack of material layers 500 also includes an upper dielectric layer 508 above first layer of patterned metal 302. According to some embodiments, upper dielectric layer 508 acts as a radome layer to protect the other layers of stack of material layers 500 from the environment. According to some embodiments, upper dielectric layer 508 has a relative high dielectric constant (e.g., higher than the dielectric constant of antenna substrate 504) in order to generate a leaky surface wave along the top surface of first layer of patterned metal 302. The leaky surface wave will direct the radiation in a forward direction towards the front of the aerodynamic system. In some embodiments, upper dielectric layer 508 has a dielectric constant between 2.75 and 3.25. In some embodiments, upper dielectric layer 508 has a thickness of around 1 mm. The thickness of upper dielectric layer 508 may be designed to be about ¼ wavelength of the RF radiation of interest, and thus may change depending on the application. In some embodiments, upper dielectric layer 508 includes a Teflon-based polymer.

According to some embodiments, glue layers 510 are used to bond certain layers together within stack of material layers 500. For example, stack of material layers 500 includes glue layers 510 between first layer of patterned metal 302 and upper dielectric layer 508, between second layer of patterned metal 306 and lower dielectric layer 506, and between lower dielectric layer 506 and outer metallic surface 502. Any adhesive material can be used for glue layers 510. In some embodiments, the adhesive material used in glue layers 510 has a dielectric constant between about 3.25 and about 3.75. Glue layers 510 may have a thickness of between about 100 micrometers and 200 micrometers.

Figure 5B:
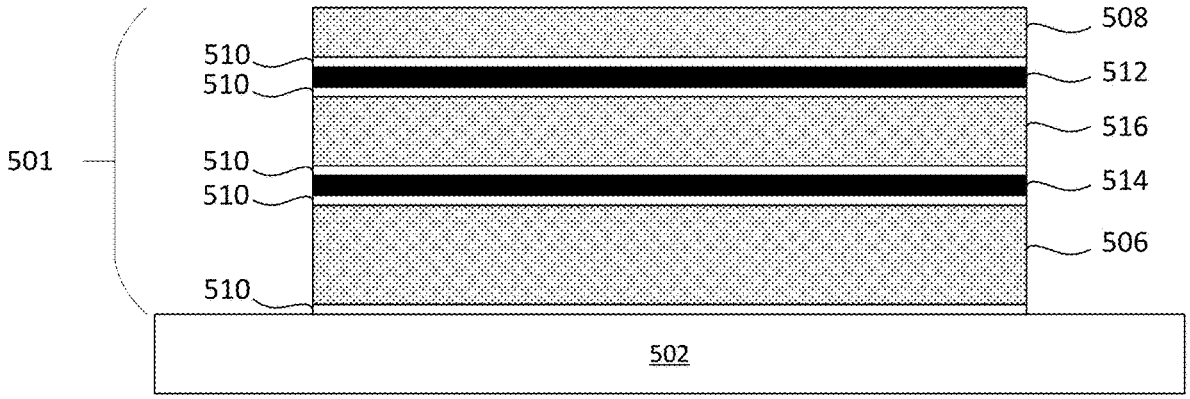

FIG. 5B illustrates a cross-section view of another stack of material layers 501 that make up antenna structure wrapped around a fuselage of an aerodynamic system, according to an embodiment. Stack of material layers 501 may be disposed on an outer metallic surface 502 of the fuselage. According to some embodiments, stack of material layers 501 differs from stack of material layers 500 by having a first patterned metal sheet 512 and a second patterned metal sheet 514 as separate metal sheets instead of patterned metal layers on substrate 504. Accordingly, many of the layers in stack of material layers 501 are similar to the layers in stack of material layers 500 and use the same numeric labels.

According to some embodiments, stack of material layers 501 includes more glue layers 510 compared to stack of material layers 500 to secure first patterned metal sheet 512 and second patterned metal sheet 514. In some examples, stack of material layers 501 includes a thin layer of polyimide adjacent first patterned metal sheet 512 and between first patterned metal sheet 512 and glue layer 510, and stack of material layers 501 includes a thin layer of polyimide adjacent second patterned metal sheet 514 and between second patterned metal sheet 514 and glue layer 510.

Stack of material layers 501 also includes a midsection dielectric layer 516 sandwiched between first patterned metal sheet 512 and second patterned metal sheet 514. Midsection dielectric layer 516 may have a lower dielectric constant than antenna substrate 504. For example, midsection dielectric layer 516 may have a dielectric constant between 1 and 1.2. Midsection dielectric layer 516 may be the same dielectric material as lower dielectric layer 506. In some embodiments, midsection dielectric layer 516 has a thickness of around 1 mm.

Figure 6A:
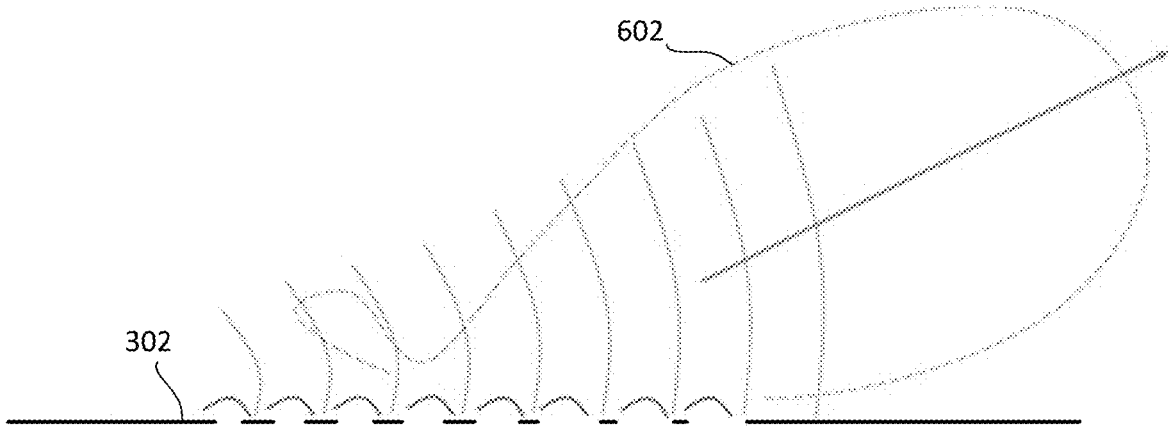
FIGS. 6A and 6B each illustrates a radiation pattern generated by an endfire antenna design, in accordance with an embodiment of the present disclosure.
Figure 6B:
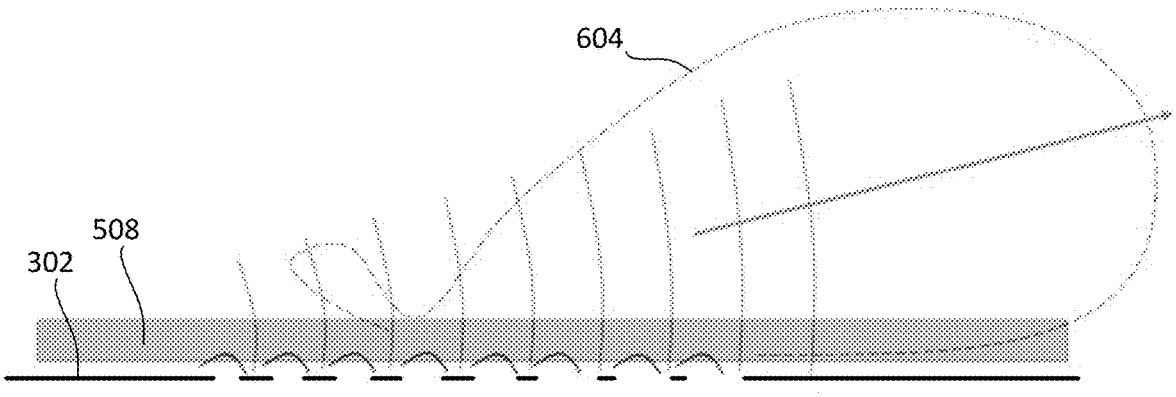

FIGS. 6A and 6B compare RF radiation signatures for different slotted endfire antenna designs, according to some embodiments. FIG. 6A illustrates a transmitting radiation pattern 602 away from the slotted surface of first layer of patterned metal 302. Since first layer of patterned metal 302 acts as a finite metal ground plane, radiation pattern 602 radiates away from the grazing angle along first layer of patterned metal 302. Since the antenna structure is located back away from the front of the aerodynamic system, it is beneficial for homing applications to have the gain directed more towards the front of the aerodynamic system.

FIG. 6B illustrates another transmitting radiation pattern 604 away from the slotted surface of first layer of patterned metal 302 that includes a dielectric layer (e.g., upper dielectric layer 508). The presence of upper dielectric layer 508 slows the speed of the surface wave and causes the surface wave to gradually radiate as a leaky wave during propagation down first layer of patterned metal 302. The slowed surface wave causes radiation pattern 604 to radiate at a lower angle closer to the surface, thus directing the gain towards the front of the aerodynamic system.

In some embodiments, a thickness of upper dielectric layer 508 is less than or equal to ½ the wavelength of the RF radiation being transmitted. Although the discussion thus far describes a dielectric material being used as the top layer of the material stack to generate the leaky surface wave, other materials can be used as well to create a similar effect. For example, a layer of magnetic material can also cause a leaky surface wave. In some other examples, a corrugated metal pattern adds inductance which can cause a leaky surface wave.

As noted above, the slots 304 on first layer of patterned metal 302 can be altered to enable a dual-band series feed endfire design, according to some embodiments. Having slots that are all the same length provides a single-band design for a given range of wavelengths. By changing the lengths of some of the slots, different frequency bands can be transmitted or received using the antenna.

Figure 7A:
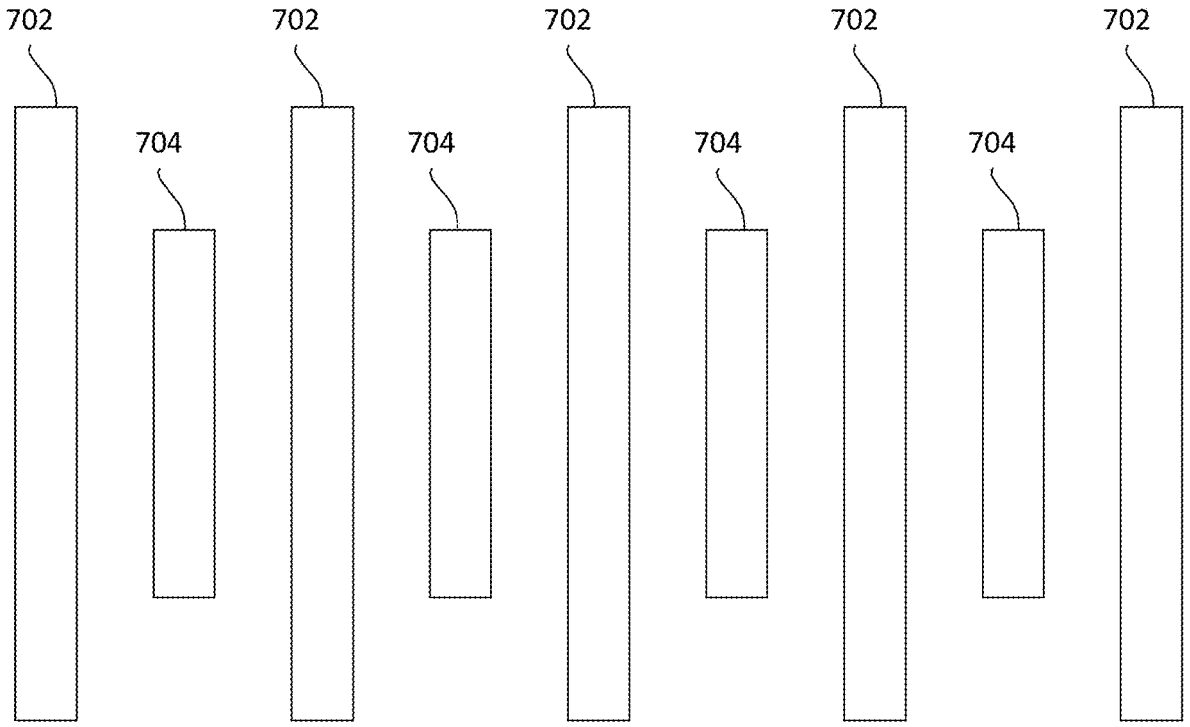
FIGS. 7A and 7B each illustrates a slot geometry for use in an endfire antenna design, in accordance with an embodiment of the present disclosure.

FIG. 7A illustrates one example slot design that could be used in place of slots 304 on first layer of patterned metal 302. The slot design includes a first plurality of slots 702 having a first length and a second plurality of slots 704 having a second length shorter than the first length. Each of the second plurality of slots 704 alternates with one of the first plurality of slots 702. By singularly alternating the different slot lengths, two different frequency bands can be used. According to some embodiments, a first frequency band associated with first plurality of slots 702 is about double the frequency of a second frequency band associated with second plurality of slots 704. According to some embodiments, widths of at least first plurality of slots 702 increase along the length of the endfire antenna, similar to the increasing widths of slots 304. In some embodiments, more than one of the second plurality of slots 704 is included between each pair of first plurality of slots 702. Increasing the number of shorter slots between pairs of longer slots increases the ratio between the frequency bands. For example, if two shorter slots (second plurality of slots 704) are provided between each pair of longer slots (first plurality of slots 702) then the two frequency bands will have a 3:1 ratio.

Figure 7B:
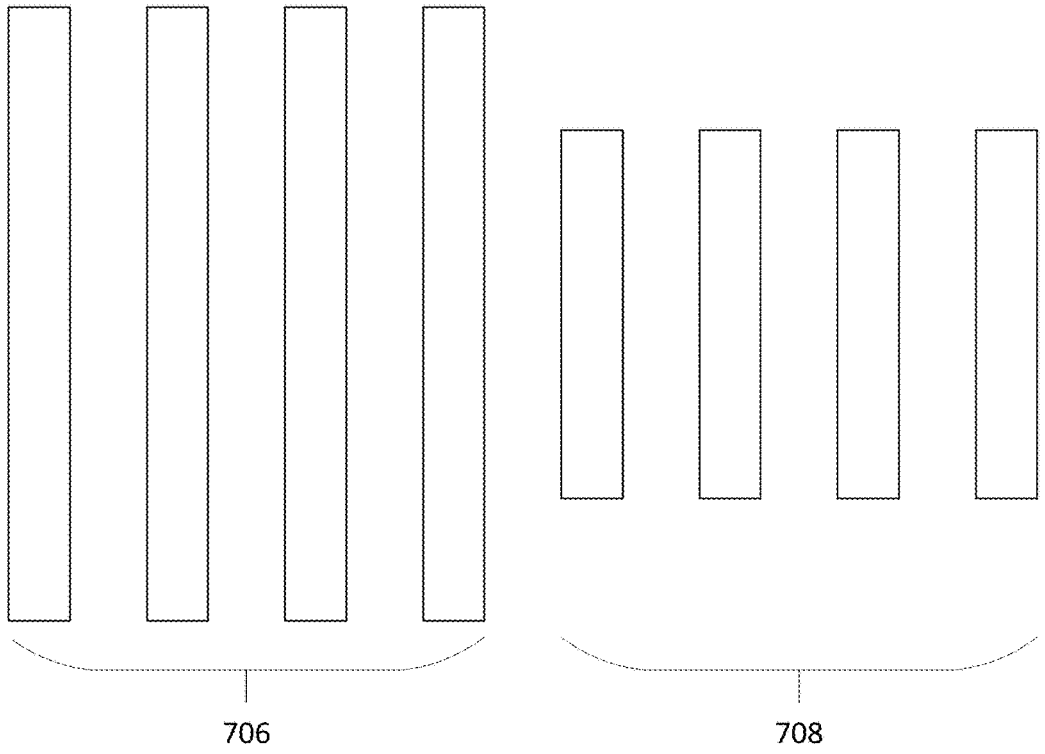

FIG. 7B illustrates another example slot design that could be used in place of slots 304 on first layer of patterned metal 302 two create two different frequency bands. The slot design includes a first plurality of slots 706 having a first length and a second plurality of slots 708 having a second length shorter than the first length, with first plurality of slots 706 being in a first group of slots that is adjacent to a second group of slots that includes second plurality of slots 708. In some embodiments, first plurality of slots 706 is aligned over the wider portion of the tapered feedline and second plurality of slots 708 is aligned over the narrower portion of the tapered feedline, the tapered feedline being on a separate metal layer beneath first layer of patterned metal 302 as described with reference to FIG. 5B. In some embodiments, the lengths of second plurality of slots 708 become increasingly longer in the direction of first plurality of slots 706. In some embodiments, the cavity beneath the endfire antenna is shaped to fit the different slot lengths (e.g., the cavity is wider beneath first plurality of slots 706 and narrower beneath second plurality of slots 708).

Figure 8:
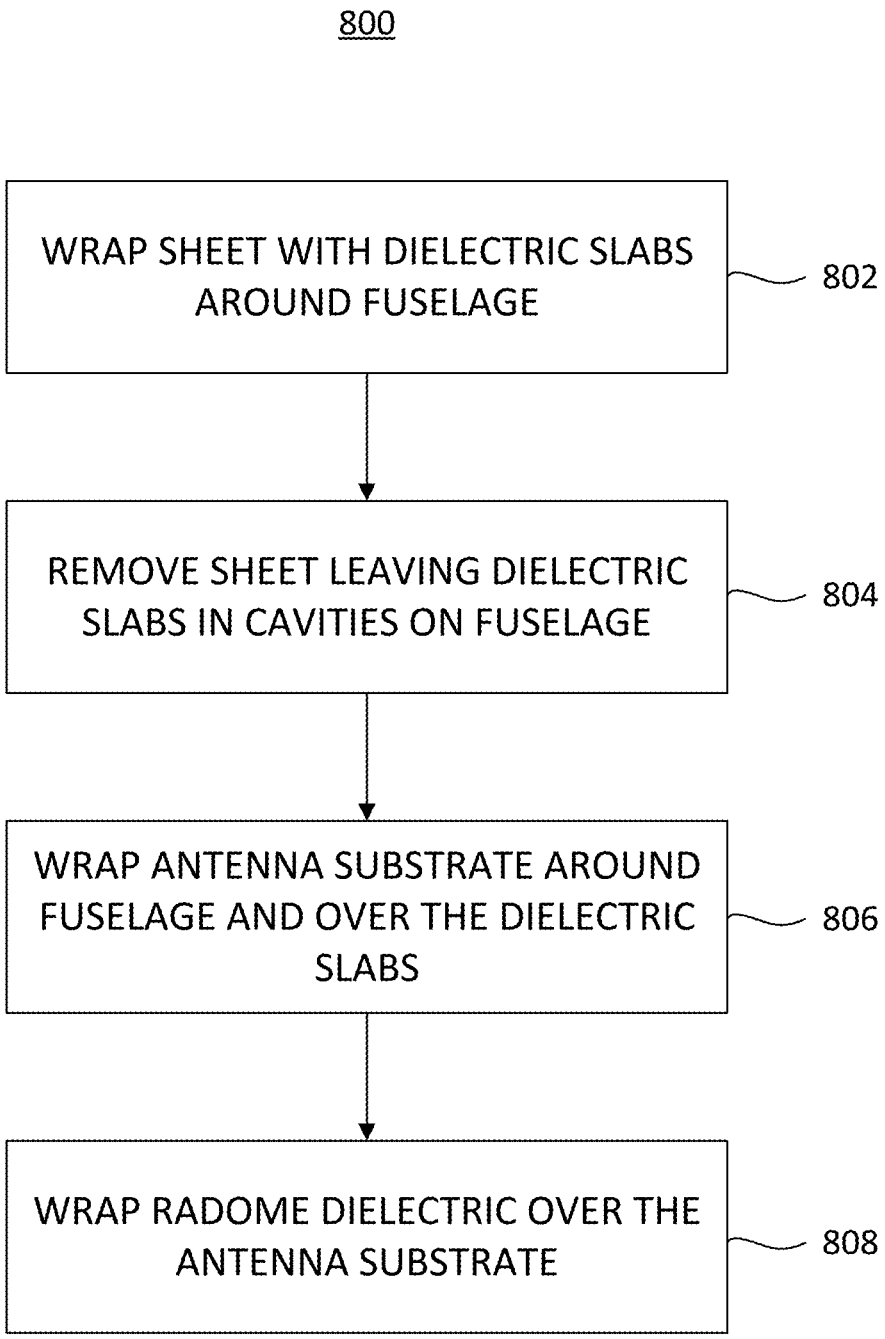
FIG. 8 is a flowchart describing a method of forming an antenna structure around the fuselage of an aerodynamic system, in accordance with an embodiment of the present disclosure.

FIG. 8 is a flow diagram of an example method 800 for fabricating an endfire antenna structure (such as antenna structure 104) around a fuselage of an aerodynamic system, according to an embodiment of the present disclosure. While the methods described herein may appear to have a certain order to their operations, other embodiments may not be so limited. Accordingly, the order of the operations can be varied between embodiments, as would be apparent in light of this disclosure.

Method 800 begins at block 802 where a sheet having slabs of dielectric material attached to the sheet is wrapped around the fuselage of an aerodynamic system. According to some embodiments, the slabs of dielectric material are shaped to fit within cavities formed in the fuselage, such that a given slab of dielectric material fits within a corresponding cavity. The slabs of dielectric material may be the same as lower dielectric layer 506 as part of stack of material layers 500. Accordingly, the slabs of dielectric material may be PMI with a dielectric constant between 1 and 1.2. The slabs of dielectric material may be loosely bonded to the sheet such that they can be easily detached as the sheet is peeled away from the fuselage. According to some embodiments, the sheet is any epoxy-based material, such as AF126 sheet epoxy from 3M (Maplewood, Minn.).

Method 800 continues with block 804 where the sheet is peeled away from the fuselage leaving behind the slabs of dielectric material. According to some embodiments, each of the slabs of dielectric material is left within a corresponding cavity around the circumference of the fuselage.

Method 800 continues with block 806 where an antenna substrate (such as antenna substrate 300) is wrapped around the fuselage over the slabs of dielectric material. According to some embodiments, the antenna substrate is wrapped such that each endfire antenna on the antenna substrate is aligned over a corresponding slab of dielectric material. For example, if 8 endfire antennas are arranged in parallel across the antenna substrate, then 8 slabs of dielectric material would be disposed around at least a portion of the circumference of the fuselage to align with each of the 8 endfire antennas on the antenna substrate. After wrapping the antenna substrate around at least a portion of the circumference of the fuselage, a clamshell brace can be applied around the outside of the antenna substrate to secure it in place and allow any adhesives to finish curing.

Method 800 continues with block 808 where a top dielectric layer is wrapped around the fuselage and over the antenna substrate. According to some embodiments, the top dielectric layer acts as a radome structure for the underlying antenna substrate and may be the same as upper dielectric layer 508 as part of stack of material layers 500. Accordingly, the top dielectric layer may include a Teflon-based polymer with a dielectric constant between 2.75 and 3.25. After wrapping the top dielectric layer around at least a portion of the underlying antenna substrate, a clamshell brace can be applied around the outside of the top dielectric layer to secure it in place and allow any adhesives to finish curing.

Numerous specific details have been set forth herein to provide a thorough understanding of the embodiments. It will be understood by an ordinarily-skilled artisan, however, that the embodiments may be practiced without these specific details. In other instances, well known operations, components and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is an antenna structure configured to wrap around a fuselage of an aerodynamic system, the fuselage having a length along a first direction. The antenna structure comprises a first layer of patterned metal, a second layer of patterned metal, and a stack of material layers that includes the first layer of patterned metal and the second layer of patterned metal. The first layer of patterned metal includes a plurality of parallel slots etched through the metal, each of the parallel slots extending lengthwise in a second direction perpendicular to the first direction. The second layer of patterned metal includes a tapered radio frequency (RF) feedline having a narrow end and a wide end, the narrow end being coupled to an input/output (I/O) antenna connection, wherein the second layer of patterned metal is aligned over the first layer of patterned metal such that the tapered RF feedline has a length that extends across the plurality of parallel slots in the first direction. The stack of material layers is flexible such that the stack of material layers is configured to wrap at least partially around the fuselage of the aerodynamic system.

Example 2 includes the subject matter of Example 1, wherein the stack of material layers is configured to wrap around an entire circumference of the fuselage.

Example 3 includes the subject matter of Example 1 or 2, wherein the stack of material layers comprises: a first dielectric layer between the first layer of patterned metal and the second layer of patterned metal; and a second dielectric layer over the first layer of patterned metal, such that the first layer of patterned metal is sandwiched between the first and second dielectric layers.

Example 4 includes the subject matter of Example 3, wherein the second dielectric layer has a higher dielectric constant that then the first dielectric layer.

Example 5 includes the subject matter of Example 3 or 4, wherein the first dielectric layer comprises polymethacrylimide (PMI) and the second dielectric layer comprises polytetrafluoroethylene (PTFE).

Example 6 includes the subject matter of any one of Examples 1-5, wherein the first layer of patterned metal is on a front side of a flexible substrate and the second layer of patterned metal is on a backside of the flexible substrate.

Example 7 includes the subject matter of Example 6, wherein the stack of material layers comprises a dielectric layer over the first layer of patterned metal, wherein the dielectric layer has a higher dielectric constant than the flexible substrate.

Example 8 includes the subject matter of Example 6 or 7, further comprising one or more plated through holes that connect between the first layer of patterned metal and the second layer of patterned metal.

Example 9 includes the subject matter of any one of Examples 1-8, wherein the plurality of parallel slots each have the same length.

Example 10 includes the subject matter of Example 9, wherein the plurality of parallel slots have widths that increase along the first direction, such that the wide end of the tapered RF feedline is aligned over a slot with a largest width of the plurality of parallel slots, and the narrow end of the tapered RF feedline is aligned over a slot with a smallest width of the plurality of parallel slots.

Example 11 includes the subject matter of any one of Examples 1-10, wherein the plurality of parallel slots includes a first set of slots having a first length and a second set of slots having a second length shorter than the first length.

Example 12 includes the subject matter of Example 11, wherein slots from the first set of slots alternate with slots from the second set of slots along the first direction.

Example 13 includes the subject matter of Example 11, wherein the first set of slots is adjacent to the second set of slots.

Example 14 includes the subject matter of any one of Examples 1-13, wherein the second layer of patterned metal comprises a ground plane, and wherein the antenna structure further comprises a resistor coupled between the tapered RF feedline and the ground plane.

Example 15 includes the subject matter of any one of Examples 1-14, wherein the plurality of parallel slots is a first set of parallel slots, and the first layer of patterned metal comprises multiple sets of parallel slots, each of the multiple sets of parallel slots being parallel to one another.

Example 16 includes the subject matter of Example 15, wherein the second layer of patterned metal comprises a plurality of tapered RF feedlines, wherein each tapered RF feedline of the plurality of tapered RF feedlines is aligned over a corresponding set of parallel slots of the multiple sets of parallel slots.

Example 17 includes the subject matter of any one of Examples 1-16, further comprising a dielectric material between the stack of material layers and the fuselage.

Example 18 includes the subject matter of Example 17, wherein the fuselage has a cavity and the dielectric material is disposed within the cavity.

Example 19 is a guided munition comprising the antenna structure of any one of Examples 1-18.

Example 20 is an RF system configured for use on an aerodynamic system. The RF system includes a processor configured to generate a digital signal, at least one digital to analog converter (DAC) configured to transform the digital signal into an analog signal, front end circuitry configured to receive the analog signal from the DAC and perform any of amplification, up-converting, modulation, or filtering to the analog signal, thereby providing a transmission signal, and an antenna structure configured to radiate the transmission signal received from the front end circuitry. The antenna structure includes a first layer of patterned metal, a second layer of patterned metal, and a stack of material layers that includes the first layer of patterned metal and the second layer of patterned metal. The first layer of patterned metal includes a plurality of parallel slots etched through the metal, each of the parallel slots extending lengthwise in a first direction that is perpendicular to a second direction along a length of the aerodynamic system extending between a nose cone and a tail end of the aerodynamic system. The second layer of patterned metal includes a tapered radio frequency (RF) feedline having a narrow end a wide end, the narrow end being coupled to an input/output (I/O) antenna connection, wherein the second layer of patterned metal is aligned over the first layer of patterned metal such that the tapered RF feedline has a length that extends across the plurality of parallel slots in the second direction. The stack of material layers is flexible such that the stack of material layers is configured to wrap at least partially around a fuselage of the aerodynamic system.

Example 21 includes the subject matter of Example 20, wherein the stack of material layers is configured to wrap around an entire circumference of the fuselage.

Example 22 includes the subject matter of Example 20 or 21, wherein the stack of material layers comprises: a first dielectric layer between the first layer of patterned metal and the second layer of patterned metal; and a second dielectric layer over the first layer of patterned metal, such that the first layer of patterned metal is sandwiched between the first and second dielectric layers.

Example 23 includes the subject matter of Example 22, wherein the second dielectric layer has a higher dielectric constant that then the first dielectric layer.

Example 24 includes the subject matter of Example 22 or 23, wherein the first dielectric layer comprises polymethacrylimide (PMI) and the second dielectric layer comprises polytetrafluoroethylene (PTFE).

Example 25 includes the subject matter of any one of Examples 20-24, wherein the first layer of patterned metal is on a front side of a flexible printed circuit board (PCB) and the second layer of patterned metal is on a backside of the flexible PCB.

Example 26 includes the subject matter of Example 25, wherein the stack of material layers comprises a dielectric layer over the first layer of patterned metal, wherein the dielectric layer has a higher dielectric constant than the flexible PCB.

Example 27 includes the subject matter of Example 25 or 26, wherein the antenna structure further comprises one or more plated through holes that connect between the first layer of patterned metal and the second layer of patterned metal.

Example 28 includes the subject matter of any one of Examples 20-27, wherein the plurality of parallel slots each have the same length.

Example 29 includes the subject matter of Example 28, wherein the plurality of parallel slots have widths that increase along the second direction, such that the wide end of the tapered RF feedline is aligned over a slot with a largest width of the plurality of parallel slots, and the narrow end of the tapered RF feedline is aligned over a slot with a smallest width of the plurality of parallel slots.

Example 30 includes the subject matter of any one of Examples 20-29, wherein the plurality of parallel slots includes a first set of slots having a first length and a second set of slots having a second length shorter than the first length.

Example 31 includes the subject matter of Example 30, wherein slots from the first set of slots alternate with slots from the second set of slots along the second direction.

Example 32 includes the subject matter of Example 30, wherein the first set of slots is adjacent to the second set of slots.

Example 33 includes the subject matter of any one of Examples 20-32, wherein the second layer of patterned metal comprises a ground plane, and wherein the antenna structure further comprises a resistor coupled between the tapered RF feedline and the ground plane.

Example 34 includes the subject matter of any one of Examples 20-33, wherein the plurality of parallel slots is a first set of parallel slots, and the first layer of patterned metal comprises multiple sets of parallel slots, each of the multiple sets of parallel slots being parallel to one another.

Example 35 includes the subject matter of Example 34, wherein the second layer of patterned metal comprises a plurality of tapered RF feedlines, wherein each tapered RF feedline of the plurality of tapered RF feedlines is aligned over a corresponding set of parallel slots of the multiple sets of parallel slots.

Example 36 includes the subject matter of any one of Examples 20-35, wherein the aerodynamic system is a guided munition.

Example 37 includes the subject matter of Example 36, wherein the transmission signal is a homing signal used to guide the guided munition.

Example 38 includes the subject matter of any one of Examples 20-37, wherein the antenna structure further comprises a dielectric material between the stack of material layers and the fuselage.

Example 39 includes the subject matter of Example 38, wherein the fuselage has a cavity and the dielectric material is disposed within the cavity.

Example 40 is a method of making an antenna structure configured for use on an aerodynamic system. The method includes wrapping a sheet having a plurality of dielectric material slabs around a fuselage of the aerodynamic system; removing the sheet, thus leaving behind the dielectric material slabs within corresponding cavities in the fuselage; wrapping a flexible substrate around the fuselage and over the dielectric material slabs. The flexible substrate comprises a first layer of patterned metal on a first surface of the flexible substrate, wherein the patterned metal of the first layer includes a plurality of parallel slots etched through the metal, each of the parallel slots extending lengthwise in a first direction, and a second layer of patterned metal on a second surface of the flexible substrate opposite from the first surface, wherein the patterned metal of the second layer includes a tapered radio frequency (RF) feedline having a narrow end a wide end, the narrow end being coupled to an input/output (I/O) antenna connection, wherein the second layer of patterned metal is aligned with the first layer of patterned metal such that the tapered RF feedline has a length that extends across the plurality of parallel slots in a second direction substantially perpendicular to the first direction. The method further includes wrapping a dielectric layer at least partially around the fuselage and over the flexible substrate.

What is claimed is:

1. An antenna structure configured to wrap around a fuselage of an aerodynamic system, the fuselage having a length along a first direction, the antenna structure comprising:

a first layer of patterned metal, wherein the patterned metal of the first layer includes a plurality of parallel slots etched through the metal, each of the parallel slots extending lengthwise in a second direction perpendicular to the first direction;

a second layer of patterned metal, wherein the patterned metal of the second layer includes a tapered radio frequency (RF) feedline having a narrow end and a wide end, the narrow end being coupled to an input/output (I/O) antenna connection, wherein the second layer of patterned metal is aligned over the first layer of patterned metal such that the tapered RF feedline has a length that extends across the plurality of parallel slots in the first direction; and a stack of material layers that includes the first layer of patterned metal and the second layer of patterned metal, the stack of material layers being flexible such that the stack of material layers is configured to wrap at least partially around the fuselage of the aerodynamic system.

2. The antenna structure of claim 1, wherein the stack of material layers is configured to wrap around an entire circumference of the fuselage.

3. The antenna structure of claim 1, wherein the first layer of patterned metal is on a front side of a flexible substrate and the second layer of patterned metal is on a backside of the flexible substrate.

4. The antenna structure of claim 3, wherein the stack of material layers comprises a dielectric layer over the first layer of patterned metal, wherein the dielectric layer has a higher dielectric constant than the flexible substrate.

5. The antenna structure of claim 3, further comprising one or more plated through holes that connect between the first layer of patterned metal and the second layer of patterned metal.

6. The antenna structure of claim 1, wherein the plurality of parallel slots have widths that increase along the first direction, such that the wide end of the tapered RF feedline is aligned over a slot with a largest width of the plurality of parallel slots, and the narrow end of the tapered RF feedline is aligned over a slot with a smallest width of the plurality of parallel slots.

7. The antenna structure of claim 1, wherein the second layer of patterned metal comprises a ground plane, and wherein the antenna structure further comprises a resistor coupled between the tapered RF feedline and the ground plane.

8. The antenna structure of claim 1, further comprising a dielectric material between the stack of material layers and the fuselage.

9. The antenna structure of claim 8, wherein the fuselage has a cavity and the dielectric material is disposed within the cavity.

10. An RF system configured for use on an aerodynamic system, the RF system comprising:

a processor configured to generate a digital signal;

at least one digital to analog converter (DAC) configured to transform the digital signal into an analog signal;

front end circuitry configured to receive the analog signal from the DAC and perform any of amplification, upconverting, modulation, or filtering to the analog signal, thereby providing a transmission signal; and an antenna structure configured to radiate the transmission signal received from the front end circuitry, wherein the antenna structure comprises a first layer of patterned metal, wherein the patterned metal of the first layer includes a plurality of parallel slots etched through the metal, each of the parallel slots extending lengthwise in a first direction that is perpendicular to a second direction along a length of the aerodynamic system extending between a nose cone and a tail end of the aerodynamic system, a second layer of patterned metal, wherein the patterned metal of the second layer includes a tapered radio frequency (RF) feedline having a narrow end and a wide end, the narrow end being coupled to an input/output (I/O) antenna connection, wherein the second layer of patterned metal is aligned over the first layer of patterned metal such that the tapered RF feedline has a length that extends across the plurality of parallel slots in the second direction, and a stack of material layers that includes the first layer of patterned metal and the second layer of patterned metal, the stack of material layers being flexible such that the stack of material layers is configured to wrap at least partially around a fuselage of the aerodynamic system.

11. The RF system of claim 10, wherein the stack of material layers is configured to wrap around an entire circumference of the fuselage.

12. The RF system of claim 10, wherein the first layer of patterned metal is on a front side of a flexible printed circuit board (PCB) and the second layer of patterned metal is on a backside of the flexible PCB.

13. The RF system of claim 12, wherein the stack of material layers comprises a dielectric layer over the first layer of patterned metal, wherein the dielectric layer has a higher dielectric constant than the flexible PCB.

14. The RF system of claim 12, wherein the antenna structure further comprises one or more plated through holes that connect between the first layer of patterned metal and the second layer of patterned metal.

15. The RF system of claim 10, wherein the plurality of parallel slots have widths that increase along the second direction, such that the wide end of the tapered RF feedline is aligned over a slot with a largest width of the plurality of parallel slots, and the narrow end of the tapered RF feedline is aligned over a slot with a smallest width of the plurality of parallel slots.

16. The RF system of claim 10, wherein the second layer of patterned metal comprises a ground plane, and wherein the antenna structure further comprises a resistor coupled between the tapered RF feedline and the ground plane.

17. The RF system of claim 10, wherein the plurality of parallel slots is a first set of parallel slots, and the first layer of patterned metal comprises multiple sets of parallel slots, each of the multiple sets of parallel slots being parallel to one another.

18. The RF system of claim 10, wherein the aerodynamic system is a guided munition.

19. The RF system of claim 18, wherein the transmission signal is a homing signal used to guide the guided munition.

20. A method of making an antenna structure configured for use on an aerodynamic system, the method comprising:

wrapping a sheet having a plurality of dielectric material slabs around a fuselage of the aerodynamic system;

removing the sheet, thus leaving behind the dielectric material slabs within corresponding cavities in the fuselage;

wrapping a flexible substrate around the fuselage and over the dielectric material slabs, wherein the flexible substrate comprises a first layer of patterned metal on a first surface of the flexible substrate, wherein the patterned metal of the first layer includes a plurality of parallel slots etched through the metal, each of the parallel slots extending lengthwise in a first direction, and a second layer of patterned metal on a second surface of the flexible substrate opposite from the first surface, wherein the patterned metal of the second layer includes a tapered radio frequency (RF) feedline having a narrow end and a wide end, the narrow end being coupled to an input/output (I/O) antenna connection, wherein the second layer of patterned metal is aligned with the first layer of patterned metal such that the tapered RF feedline has a length that extends across the plurality of parallel slots in a second direction substantially perpendicular to the first direction; and wrapping a dielectric layer at least partially around the fuselage and over the flexible substrate.

* * * * *